US007121077B2

(12) United States Patent
Andrews et al.

(10) Patent No.: US 7,121,077 B2
(45) **Date of Patent: *Oct. 17, 2006**

(54) ANTIMICROBIAL CUT-RESISTANT COMPOSITE YARN AND GARMENTS KNITTED OR WOVEN THEREFROM

(75) Inventors: Dean Riley Andrews, Concord, NC (US); Christopher D. Andrews, Concord, NC (US); Gregory V. Andrews, Concord, NC (US); John D. Simmons, Rockwell, NC (US)

(73) Assignee: World Fibers, Inc., Concord, NC (US)

( * ) Notice: Subject to any disclaimer, the term of this patent is extended or adjusted under 35 U.S.C. 154(b) by 56 days.

This patent is subject to a terminal disclaimer.

(21) Appl. No.: 10/818,117

(22) Filed: Apr. 5, 2004

(65) Prior Publication Data

US 2004/0187471 A1 Sep. 30, 2004

Related U.S. Application Data

(63) Continuation-in-part of application No. 09/702,619, filed on Oct. 31, 2000, now Pat. No. 6,779,330.

(51) Int. Cl.
*D02G 3/02* (2006.01)

(52) U.S. Cl. ..... 57/210; 57/232

(58) Field of Classification Search ..... 57/210, 57/229–232, 236, 241, 243–251
See application file for complete search history.

(56) References Cited

U.S. PATENT DOCUMENTS

| | | | |
|---|---|---|---|
| 429,005 | A | 5/1890 | Bird |
| 831,108 | A | 9/1906 | Ryder |
| 1,275,469 | A | 8/1918 | Pruessman |
| 1,574,004 | A | 2/1926 | Ryder |
| 1,860,030 | A | 5/1932 | Hinchliff |
| 1,947,302 | A | 2/1934 | Meiwald |
| RE19,551 | E | 4/1935 | Meiwald |
| 2,006,275 | A | 6/1935 | Meiwald |
| 2,165,290 | A | 7/1939 | Oass |
| 2,250,863 | A | 7/1941 | Goodloe |
| 2,335,644 | A | 11/1943 | Camp |
| 3,277,564 | A | 10/1966 | Webber et al. |

(Continued)

FOREIGN PATENT DOCUMENTS

| | | |
|---|---|---|
| DE | 315038 | 10/1919 |

(Continued)

OTHER PUBLICATIONS

Kathryn L Hatch, Textile Science, 1993, West Publishing Company, 1st edition, p. 92.*

(Continued)

*Primary Examiner*—Shaun R. Hurley
(74) *Attorney, Agent, or Firm*—Adams Evans P.A.

(57) ABSTRACT

An antimicrobial, cut-resistant composite yarn has a core including at least one cut-resistant strand, and a cover including at least one strand wrapped around and enclosing the core. At least one strand in either the core or the cover is treated with and incorporates an antimicrobial compound. In addition, the yarn can include one or more channel fibers to facilitate movement of moisture within the composite yarn so that the moisture contacts the antimicrobial compound, thereby enhancing the efficacy of the antimicrobial compound. The yarn can be used to fabricate cut-resistant garments, such as gloves, worn by meat cutters and others who work with knives, saws and other sharp implements. The antimicrobial effect reduces bacteria, mold and fungi growth on the garments between washings.

13 Claims, 5 Drawing Sheets

U.S. PATENT DOCUMENTS

| | | | |
|---|---|---|---|
| 3,288,175 | A | 11/1966 | Valko |
| 3,490,224 | A | 1/1970 | Bourgeas |
| 3,572,397 | A | 3/1971 | Austin |
| 3,607,822 | A | 9/1971 | Nishino |
| 3,699,590 | A | 10/1972 | Webber et al. |
| 3,700,515 | A | 10/1972 | Terry |
| 3,821,067 | A | 6/1974 | Taylor et al. |
| 3,883,898 | A | 5/1975 | Bymes, Sr. |
| 3,889,035 | A | 6/1975 | Jakes |
| 3,895,149 | A | 7/1975 | Sheffler et al. |
| 3,923,926 | A | 12/1975 | Harada et al. |
| 3,953,893 | A | 5/1976 | Byrnes, Sr. |
| 4,004,295 | A | 1/1977 | Byrnes, Sr. |
| 4,106,276 | A | 8/1978 | Hosoya |
| 4,202,382 | A | 5/1980 | Westhead |
| 4,267,044 | A | 5/1981 | Kroplinski et al. |
| 4,272,950 | A | 6/1981 | Bompard |
| 4,299,884 | A | 11/1981 | Payen |
| 4,384,449 | A | 5/1983 | Byrnes, Sr. et al. |
| 4,470,251 | A | 9/1984 | Bettcher |
| 4,523,425 | A | 6/1985 | Schild et al. |
| 4,534,262 | A | 8/1985 | Swenson |
| 4,640,950 | A | 2/1987 | Nishino et al. |
| 4,651,514 | A | 3/1987 | Collett |
| 4,777,789 | A | 10/1988 | Kolmes et al. |
| 4,818,587 | A | 4/1989 | Ejima et al. |
| 4,838,017 | A | 6/1989 | Kolmes et al. |
| 4,886,691 | A | 12/1989 | Wincklhofer |
| 4,912,781 | A | 4/1990 | Robins |
| 4,936,085 | A | 6/1990 | Kolmes et al. |
| 5,010,723 | A | 4/1991 | Wilen |
| 5,070,540 | A | 12/1991 | Bettcher et al. |
| 5,119,512 | A | 6/1992 | Dunbar et al. |
| 5,177,948 | A | 1/1993 | Kolmes et al. |
| 5,248,548 | A | 9/1993 | Toon |
| 5,287,690 | A | 2/1994 | Toon |
| 5,296,238 | A | 3/1994 | Sugiura et al. |
| 5,423,168 | A | 6/1995 | Kolmes et al. |
| 5,442,815 | A | 8/1995 | Cordove et al. |
| 5,568,657 | A | 10/1996 | Cordove et al. |
| 5,597,649 | A | 1/1997 | Sandor et al. |
| 5,628,172 | A | 5/1997 | Kolmes et al. |
| 5,632,137 | A | 5/1997 | Kolmes et al. |
| 5,655,358 | A | 8/1997 | Kolmes |
| 5,806,295 | A | 9/1998 | Robins et al. |
| 5,822,791 | A | 10/1998 | Baris |
| 5,845,476 | A | 12/1998 | Kolmes |
| 5,851,668 | A | 12/1998 | Sandor et al. |
| 5,965,223 | A | 10/1999 | Andrews et al. |
| 6,016,648 | A | 1/2000 | Bettcher et al. |
| 6,155,084 | A | 12/2000 | Andrews et al. |
| 6,260,344 | B1 | 7/2001 | Chakravarti |
| 6,266,951 | B1 * | 7/2001 | Chakravarti ..... 57/210 |
| 6,351,932 | B1 | 3/2002 | Hummel |
| 6,766,817 | B1 | 7/2004 | da Silva |
| 6,779,330 | B1 * | 8/2004 | Andrews et al. ..... 57/210 |

FOREIGN PATENT DOCUMENTS

| | | |
|---|---|---|
| DE | 1 610 495 | 1/1971 |
| EP | 0 458 343 A1 | 11/1991 |
| EP | 0 498 216 A1 | 8/1992 |
| FR | 718029 | 1/1932 |
| FR | 20358B/11 | 6/1977 |
| GB | 187327 | 10/1922 |
| GB | 2 018 323 | 10/1979 |
| JP | 02706B/02 | 4/1977 |
| JP | 89-252424/35 | 1/1988 |

OTHER PUBLICATIONS

Sodemetex Publication; Avantages du procede: Entire brochure; Published prior to Oct. 31, 2000.

* cited by examiner

ANTIMICROBIAL CUT-RESISTANT COMPOSITE YARN AND GARMENTS KNITTED OR WOVEN THEREFROM

TECHNICAL FIELD AND BACKGROUND OF THE INVENTION

This application is a continuation-in-part of application Ser. No. 09/702,619, filed Oct. 31, 2000 now U.S. Pat. No. 6,779,330.

The invention relates to cut-resistant yarns, particularly composite cut resistant yarns which have been treated to retard the growth of microbes which can cause food contamination and illness in humans and to garments such as cut-resistant gloves knitted or woven from such yarns. In accordance with the invention, yarns treated to retard the growth of microbes, such as bacteria, molds and fungi are knitted or woven into gloves of the type worn by meat cutters and others whose job involves working with knives, saws and other sharp objects.

Certain types of medical gloves treated with antimicrobial agents are known, as are cut-resistant gloves which achieve a measure of antimicrobial protection through the plating of a treated acetate fiber to a cut-resistant yarn as a part of the knitting process. However, applicants are not aware of a cut-resistant composite yarn which itself contains an antimicrobial component.

Users needing protection against cuts and also requiring a high level of dexterity now have a variety of products available for use. Some such products, for example, gloves knitted from fibers such as those sold under the name KEVLAR and ultrahigh molecular weight polyolefin fiber such as those sold under the name SPECTRA, provide a moderate degree of safety and protection but are extremely costly. Commercial examples of these engineered fibers include sold by Honeywell, Inc. under the name SPECTRA 900 and SPECTRA 1000 and those sold by the Du Pont Company of Wilmington, Del. under the name KEVLAR.

Less expensive yarns have been developed from various combinations of wire, fiberglass, polyester, polypropylene and polyolefin fibers which are nevertheless more cut-resistant. Several embodiments are disclosed in the following patents:

| U.S. Pat. No. | ISSUE DATE | INVENTOR | TITLE |
|---|---|---|---|
| 4,383,449 | May 23, 1983 | Byrne, Sr. | PROTECTIVE GLOVES AND THE LIKE AND A YARN WITH FLEXIBLE CORE WRAPPED WITH ARAMID FIBER |
| 4,651,514 | Mar. 24, 1987 | Collett | ELECTRICALLY NONCONDUCTIVE, ABRASION AND CUT RESISTANT YARN |
| 4,777,789 | Oct. 18, 1988 | Kolmes et al. | WIRE WRAPPED YARN FOR PROTECTIVE GARMENTS |
| 4,818,587 | Apr. 04, 1989 | Ejima et al. | NONWOVEN FABRICS AND METHOD FOR PRODUCING THEM |
| 4,838,017 | Jun. 13, 1989 | Kolmes et al. | WIRE WRAPPED YARN FOR PROTECTIVE GARMENTS |
| 4,886,691 | Dec. 12, 1989 | Wincklhofer | CUT RESISTANT JACKET FOR ROPES, WEBBING, STRAPS, INFLATABLES AND THE LIKE |

-continued

| U.S. Pat. No. | ISSUE DATE | INVENTOR | TITLE |
|---|---|---|---|
| 4,936,085 | Jun. 26, 1990 | Kolmes et al. | YARN AND GLOVE |
| 5,010,723 | Apr. 30, 1991 | Wilen | TWISTED YARN WHICH WILL MAINTAIN ITS TWIST AND PRODUCTS PRODUCED THEREFROM |
| 5,119,512 | Jun. 09, 1992 | Dunbar et al. | CUT RESISTANT YARN, FABRIC AND GLOVES |
| 5,177,948 | Jan. 12, 1993 | Kolmes et al. | YARN AND GLOVE |

U.S. Pat. No. 4,384,449 shows protective gloves and the like and a yarn comprising a core of a flexible wire alongside an aramid fiber strand or strands and a covering of aramid fiber such as that manufactured and sold under the name KEVLAR by the DuPont Company of Wilmington, Del. in which the aramid fiber is either spun or filament. Two aramid fiber strands, either spun or filament, are wrapped around the core with one strand wrapped in a clockwise direction and the other strand wrapped in a counter-clockwise direction with the opposite spiral wrapping of the strands serving to secure the strands in position on the core without any other securing means. The yarn having a flexible core with aramid fiber strands wrapped thereon is used to make protective gloves on conventional glove knitting or weaving machinery and is capable of movement in relation to needle eyes and the like without jamming in the same manner as various natural and synthetic fiber yarns. The yarn having a flexible core with aramid fiber strands wrapped thereon is also used in making various U.S. other products normally made of conventional fiber yarn.

U.S. Pat. No. 4,651,514 shows an electrically non-conductive, cut and abrasion resistant yarn for use in the manufacture of protective coverings including a core of monofilament nylon having a diameter in the range of about 0.004 to 0.020 inches, a first wrap on the core of at least one strand of aramid fiber having a cotton count size in the range of about 1/1 to 30/1 and a second wrap on the core of texturized nylon of two to eight ply construction. Each ply is made up of 24 to 44 nylon filaments with each filament being about 50–90 denier.

U.S. Pat. No. 4,777,789 shows an improved yarn, fabric and protective garment made from such yarn where the yarn, fabric and garment exhibit increased cut resistance. The yarn includes a cord made of fiber and a covering wrapped around the core, the covering includes at least one strand of wire wrapped around the core.

U.S. Pat. No. 4,818,587 shows nonwoven fabrics contain at least 30% by weight of heat-adhesive composite fibers consisting of core portion and sheath portion, the core portion being of the side-by-side type composite structure comprising two core components of different polypropylene base polymers in a composite ratio of 1:2 to 2:1, one of the core components having a Q value, expressed in terms of the weight-average molecular weight/the number-average molecular weight, equal to or higher than 6 and the other having a Q value equal to or lower than 5, and the sheath portion meeting at least the requirement that it should comprise a sheath component of a polyethylene base polymer having a melting point lower by at least 20° C. than the lower one of the melting points of the two core components. The nonwoven fabrics are bulky and soft due to the crimps of the heat-adhesive composite fibers resultant form the core portion and are stabilized by the interfiber bonds of the sheath portion.

U.S. Pat. No. 4,838,017 shows an improved yarn, fabric and protective garment made from such yarn where the yarn, fabric and garment exhibit increased cut resistance. The yarn includes a core made of fiber and a covering wrapped around the core, the covering includes at least one strand of wire wrapped around the core.

U.S. Pat. No. 4,886,691 shows a cut resistant article comprising a cut resistant jacket surrounding a less cut resistant member. The jacket comprises a fabric of yarn and the yarn consists essentially of a high strength, longitudinal strand having a tensile strength of at least 1 GPa. The strand is wrapped with another fiber or the same fiber.

U.S. Pat. No. 4,936,085 shows an improved yarn, fabric and protective garment made from such yarn, where the yarn, fabric and garment exhibit increased cut resistance, flexibility, pliability and softness. The yarn is non-metallic and includes a core made of fiber and a covering wrapped around the core. At least one of the strands is fiberglass, the non-fiberglass strands are preferably nylon or polyester.

U.S. Pat. No. 5,010,723 shows a yarn produced from two or more twisted cellulosic fibers, such as cotton or cotton rayon fibers, the plies being helically wound around a thermoplastic filament core which is subsequently melted to bind the inner portions of the yarn together so that it does not untwist or shed lint readily. The yarn is employed in a dU.S.t mop or floor mat for a shampoos bonnet for stain resistant treated carpet.

U.S. Pat. No. 5,119,512 shows a cut resistant article 20 comprising a cut resistant jacket surrounding a less cut resistant member. The jacket comprises a fabric of yarn and the yarn consists essentially of a high strength, longitudinal strand having a tensile strength of at least 1 GPa. The strand is wrapped with another fiber or the same fiber. In another embodiment, the invention is a highly cut resistant yarn of at least two nonmetallic fibers. One fiber is inherently cut resistant like high strength polyethylene, polypropylene or aramids. The other fiber in the yarn has a high level of hardness.

U.S. Pat. No. 5,177,948 shows an improved non-metallic yarn, 30 fabric and protective garment made from such yarn, where the yarn, fabric and garment exhibit increased cut resistance, flexibility, pliability and softness. The yarn is non-metallic and includes a core made of fiber and a covering wrapped around the core. At least one of the strands of the core is fiberglass, the non-fiberglass strands are preferably nylon, extended chain polyethylene, aramid or polyester.

Any of these structures can be treated in accordance with the invention of this application in order to provide antimicrobial effects to the yarn and the garment fabricated from the yarn. These yarns are generally sufficiently heat-resistant to permit periodic sterilization to kill bacteria and other microbes. Yarns treated as described in this application provide greatly retarded microbe development between sterilization treatments, thereby greatly reducing the possibility of contamination of food products.

SUMMARY OF THE INVENTION

Therefore, it is an object of the invention to provide a cut-resistant composite yarn which has been treated to provide antimicrobial effects.

It is another object of the invention to provide a cut-resistant composite yarn which has at least one carrier yarn which has been treated to provide antimicrobial effects.

It is another object of the invention to provide a cut-resistant composite yarn which is sufficiently flexible and resilient to be woven or knitted into a garments having antimicrobial effects.

The present invention provides significant protection both against cuts to the user but also retards growth of microbes which can contaminate food products be processed or handled by the User.

Typically, the core material is a strand of fiberglass. In order to minimize the amount of fiberglass fragments that break free from the fiberglass strand and irritate the skin of the person coming in contact with the fiberglass fragments, a series of covering wraps are employed. These covering wraps may also be a highly cut resistant material in and of themselves. In addition, the outer cover wrap may be a fiber that is smooth to the touch such as polyester or nylon. However, in order to maximize cut resistance, the covering wraps may be selected from the group consisting of polyolefins such as SPECTRA or aramids such as KEVLAR.

Preferably, the cover members are wrapped, wound or twisted around the core in a manner which permits successive layers to be wrapped, wound or twisted around the core in an opposite direction from the cover element immediately below.

The resulting protective yarns are then suitable for knitting into protective gloves and other protective garments. These yarns offer an inexpensive alternative to existing protective yarns while providing substantial cut protection without irritating a user's skin.

Winding the cover layers on the fiberglass core so that an adjacent cover layer is wound in a direction opposite to the layer immediately beneath it gives the protective yarn the desired characteristics at a much lower cost than existing yarns. The invented protective yarn is flexible enough that it can be knitted into a protective fabric or garment on conventional knitting or weaving-machines and yet is strong enough to offer substantial cut resistance. Finally, the invented protective yarn resists shrinkage which results from exposure to extremely high temperatures during the washing process.

These and other objects of the present invention are achieved in the preferred embodiments disclosed below by providing an antimicrobial, cut-resistant composite yarn, comprising a core member including at least one cut-resistant strand, a cover member including at least one strand wrapped around and enclosing the core member, wherein at least one strand in either the core member or the cover member is treated with and incorporates an antimicrobial compound.

By using one fiberglass core instead of multiple non-glass fiber cores, the present invention provides cut resistance equal to or greater than that obtained by using purely engineered cut resistant fibers such as SPECTRA and KEVLAR at a significantly lower cost. Substituting a lower strength hard and brittle fiber material such as fiberglass to the core of the yarn adds a significant level of cut resistance at a fraction of thee. cost. The addition of new yarn components has substantially reduced a user's manual dexterity problems and increased the protection against cuts to the protected body member.

According to one preferred embodiment of the invention, the core includes a cut-resistant strand and a synthetic core yarn, and the synthetic core yarn is treated with and incorporates the antimicrobial compound.

According to another preferred embodiment of the invention, at least one strand of either the core or the cover comprises a channel fiber. The channel fiber facilitates movement of the moisture within the composite yarn and into contact with the antimicrobial compound, thereby enhancing the efficacy of the antimicrobial compound.

According to yet another preferred embodiment of the invention, the channel fiber facilitates migration of the antimicrobial compound to an outer surface of the composite yarn, thereby enhancing efficacy of the antimicrobial compound.

According to yet another preferred embodiment of the invention, the channel fiber facilitates contact between the moisture and the antimicrobial compound at an outer surface of the composite yarn such that efficacy of the antimicrobial compound is enhanced.

According to yet another preferred embodiment of the invention, the cut-resistant strand is fiberglass, metal wire, aramid or polyolefin fiber.

According to yet another preferred embodiment of the invention, the core includes a cut-resistant strand and a synthetic core yarn, and the synthetic core yarn is treated with and incorporates the antimicrobial compound.

According to yet another preferred embodiment of the invention, the synthetic core yarn is polyester, polyethylene, polypropylene, nylon, acetate, or extended chain polyolefin.

According to yet another preferred embodiment of the invention, the cover includes at least two oppositely-wrapped synthetic cover yarns, wherein at least one of the synthetic cover yarns is treated with and incorporates the antimicrobial compound.

According to yet another preferred embodiment of the invention, the synthetic cover yarns are polyester, polyethylene, polypropylene, nylon, acetate, or extended chain polyolefin.

According to yet another preferred embodiment of the invention, the channel fiber is in the core. According to yet another preferred embodiment of the invention, the channel fiber is in the cover.

According to yet another preferred embodiment of the invention, the core includes at least one cut-resistant strand and at least one synthetic yarn strand residing in substantially parallel relation to each other.

According to yet another preferred embodiment of the invention, the cover includes an inner cover, an antimicrobial treated intermediate cover, and a channel fiber outer cover.

According to yet another preferred embodiment of the invention, the composite yarn includes a core having a cut resistant strand, a first cover including at least one extended chain polyolefin fiber strand wrapped around the core, and a second cover wrapped around the first cover in an opposite direction. The second cover is treated with and incorporates an antimicrobial compound. At least one strand of the composite yarn is a channel fiber.

According to yet another preferred embodiment of the invention, the channel fiber is in the second cover.

According to yet another preferred embodiment of the invention, the second cover includes an extended chain polyolefin fiber strand, and a third cover is wrapped around the second cover. The third cover includes the channel fiber.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

In general, the invention comprises a cut-resistant yarn which has at least two fiber components, one of which is a core yarn and one of which is a cover yarn. Either or both of the core yarn and cove yarn may themselves be comprised of two or more yarns oriented together in a predetermined, conventional manner. One of the component yarns serves as a carrier yarn for an antimicrobial agent. The carrier yarn may be part of he core or part of the cover. The resulting yarn achieves cut resistance at Level 2 or above as defined and determined by the Cut Protection Performance Test (ANSI/ISEA standard 105-2000).

Figure 1:
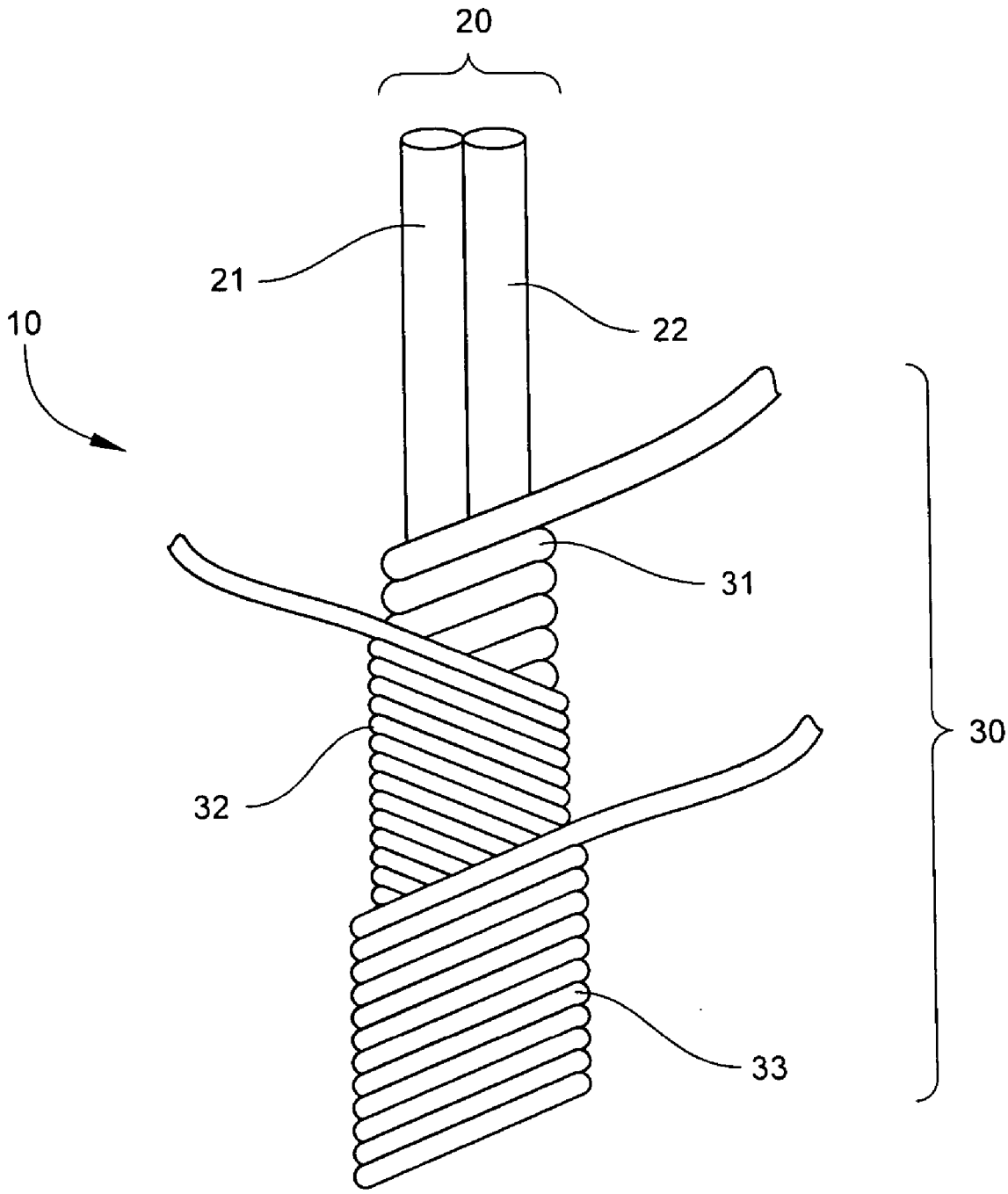
FIG. 1 is a schematic view of one yarn construction which can be treated with an antimicrobial agent in accordance with the invention.

Referring now specifically to the drawings, a protective yarn according to the present invention is illustrated in FIG. 1 and shown generally at reference numeral 10. The protective yarn 10 is a composite which includes a core member 20 and a cover member 30. The core member 20 includes a strand of fiberglass 21 and a strand of polypropylene 22. As shown in FIG. 1, the cover member 30 is preferably comprised of three helically-wrapped cover yarns—an inner cover yarn 31, wrapped, wound or twisted on the core member 20, a middle cover yarn 32 wrapped, wound or twisted on the inner cover yarn 31 such that the orientation of the middle cover helix is opposite that of the inner cover yarn 31, and a outer cover yarn 33 wrapped, wound or twisted on the middle cover 32 such that the orientation of the outer cover helix is opposite that of the middle cover yarn 32.

The fiberglass strand 21 is preferably a single longitudinal strand of G75 fiberglass, and the polypropylene strand 22 is preferably a single parallel strand of 150 denier polypropylene treated with an organic antimicrobial compound such as products sold under the names TRICLOSAN by Ciba-Geigy, and MICROBAN by Microban, Inc. Alternative yarns which may be treated include but are not limited to polyester, acetate and nylon.

The fiberglass strand 21 and polypropylene strand 22 are preferably not twisted together, but lie essentially parallel to each other.

The inner cover yarn 31 is a 375 denier, extended chain polyolefin, such as that sold under the name T1000 SPECTRA. The middle cover yarn 32 is also a 375 denier, extended chain polyolefin such as T1000 SPECTRA. The outer cover yarn is a 500 denier flat polyester yarn.

The number of turns per inch that the cover members 30 are wound around the core 20 varies according to the cover layer and cover material. In FIG. 1, the inner cover 31 is wound on the core member 20 at approximately 4.8 turns per inch. The middle cover yarn 32 is wound on the inner cover yarn 31 at approximately 9.1 turns per inch. The outer cover yarn 33 is wrapped on the middle cover yarn 32 at approximately 8.2 turns per inch.

The antimicrobially-treated polypropylene strand 22 according to a preferred embodiment of the invention is treated with an antimicrobial compound sold under the name TRICLOSAN at a rate of one percent by weight.

This concentration is sufficient to kill, in a glove fabricated from the yarn 10, 99.9 percent of the test organisms according to test method EPA-TM-002 (Dow Shaker Assay). The test organisms are *Escherichia coli, Salmonella choleraesuis* and *Klebsiella pneumonia.*

Figure 2:
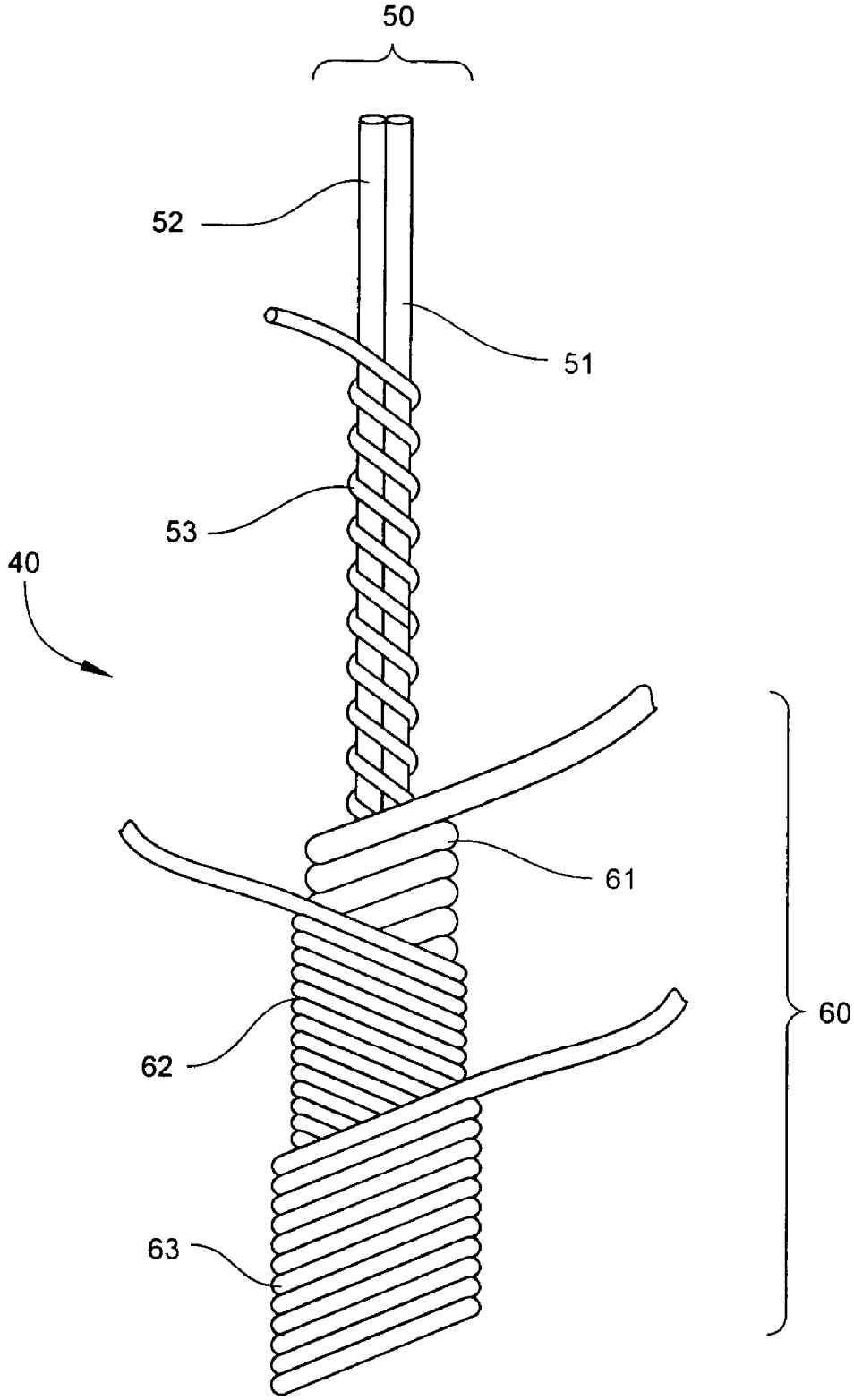
FIG. 2 is a schematic view of another yarn construction which can be treated with an antimicrobial agent in accordance with the invention.

A second embodiment of the present invention is shown in FIG. 2. A protective yarn, generally referred to at reference numeral 40, includes a core member 50 and a cover member 60. The core member 50 includes a strand of stainless steel wire 51, a strand of polyester 52, and a core wrap 53. As shown in FIG. 2, the cover member 60 is preferably comprised of three helically-wrapped cover yarns—an inner cover yarn 61, wrapped, wound or twisted on the core member 50, a middle cover yarn 62 wrapped, wound or twisted on the inner cover yarn 61 such that the orientation of the middle cover helix is opposite that of the inner cover yarn 61, and an outer cover yarn 63 wrapped, wound or twisted on the middle cover 62 such that the orientation of the outer cover helix is opposite that of the middle cover yarn 62.

The wire strand 51 is preferably a single longitudinal strand of stainless steel with a diameter of 0.003 in. The polyester strand 52 is preferably a single parallel strand of 500 denier flat polyester yarn.

The wire strand 51 and polyester strand 52 are preferably not twisted together, but lie essentially parallel to each other. The core wrap 53 is preferably a 0.002 in. diameter stainless steel wire.

The inner cover yarn 61 is 150 denier polyester. The middle cover yarn 62 and the outer cover yarn 63 are each preferably a 500 denier flat polyester yarn.

The number of turns per inch with which the cover yarns 61, 62, 63 are wound around the core member 50 varies according to the cover layer and cover material. In FIG. 2, the inner cover 61 is wound on the core member 50 at approximately 4.8 turns per inch. The middle cover yarn 62 is wound on the inner cover yarn 61 at approximately 9.1 turns per inch. The outer cover yarn 63 is wrapped on the middle cover yarn 62 at approximately 8.2 turns per inch.

The inner cover yarn 61 according to a preferred embodiment of the invention is treated with an inorganic antimicrobial silver-based compound manufactured by Agion Technologies and sold under the name AGION, and applied at a rate of one percent by weight. An alternative inorganic antimicrobial compound suitable for use is a silver and zinc oxide-based compound made by Du Pont Specialty Chemicals under the name MICROFREE.

Other constructions are possible, including yarns having single and multi-strand cores with single or multi-strand covers, with one or more of the core strands and/or cover strands treated with either an organic or inorganic antimicrobial compound of the types described above. In general, these antimicrobial agents can be used to treat a wide range of synthetic fiber yarns, including polyester, nylon, polyethylene, polypropylene and acetate.

Figure 3:
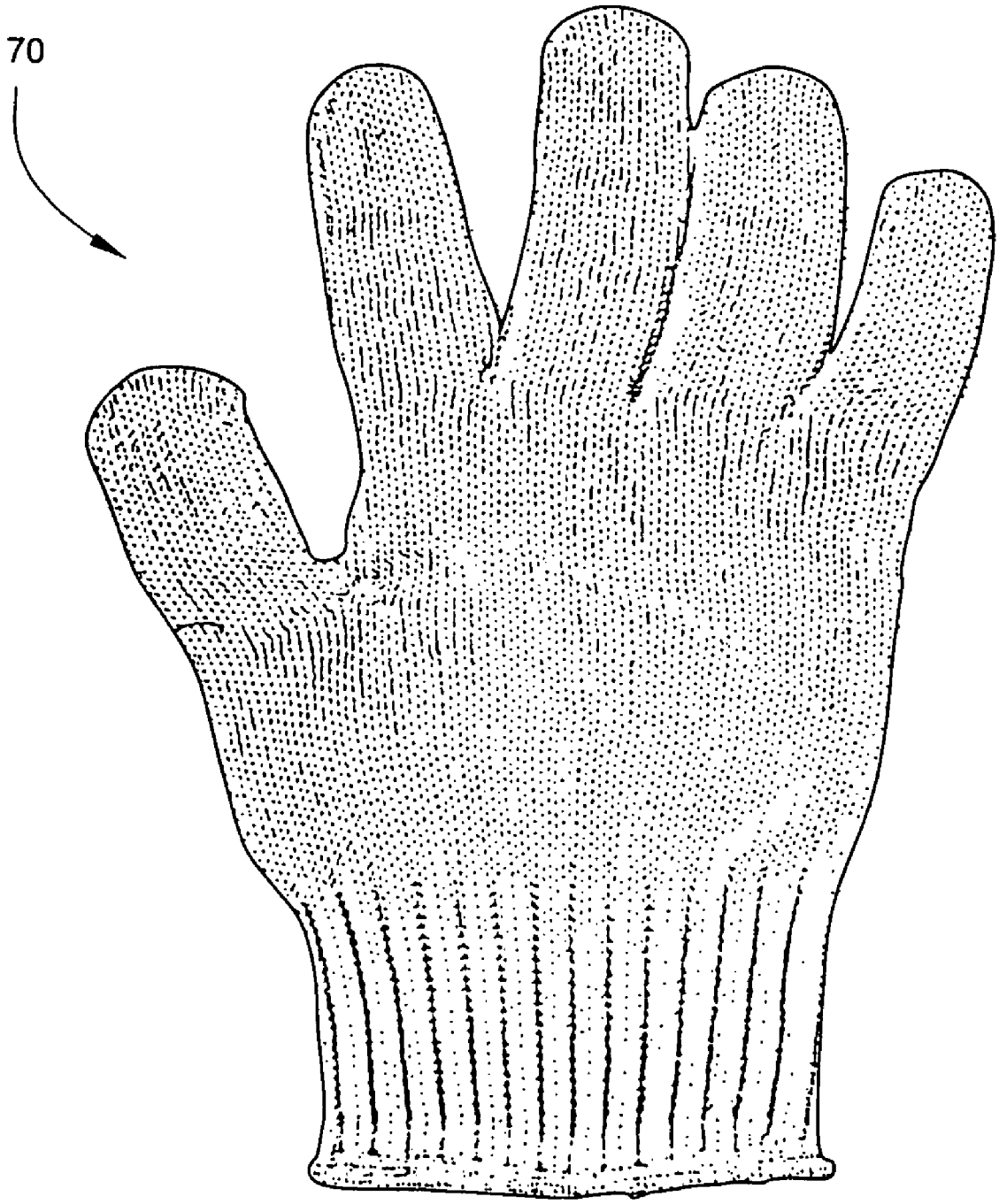
FIG. 3 is a view of a glove of the type fabricated from a yarn according to the yarns of FIGS. 1–2.

A cut-resistant glove of the type worn by meat cutters is shown in FIG. 3 at reference numeral 70.

A variety of antimicrobial fibers and yarns suitable as components for cut-resistant composite yarns and apparel are widely available in acetate, acrylic, polyester, nylon and olefins. The fibers are treated or impregnated with a variety of antimicrobial compounds, both organic and inorganic.

Organic antimicrobials for use in textiles include, but are not limited to, Triclosan, quaternary ammonium compounds, diammonium ring compounds, chitosans, N-halamine siloxanes and chlorine. Organic compounds depend upon the antimicrobial agent to leach or migrate from inside the fiber to the surface, with antimicrobial efficacy determined by the rate of migration to the surface.

Inorganic antimicrobials are also available for use in textiles, such as the silver zeolite complexes currently sold by Milliken Chemical as ALPHASAN, and Agion Technologies as AGION. Inorganic compounds depend upon the release of ions to the fiber surface for antimicrobial activity to occur, with antimicrobial efficacy determined by the rate of disassociation of the metal from the complex to which it is bound within the polymer. The rate of migration in organic compounds and the release of ions in inorganic compounds is enhanced by the presence of moisture. Moisture is a required element for antimicrobial function, inducing release of the antimicrobial at the fiber surface.

Most synthetic fibers currently employed as components of cut-resistant composite yarns, such as polyester, olefins, nylon, metallic wire and fiberglass, have low-to-zero moisture regain, meaning the yarns have little ability to absorb and retain water. Some synthetic fibers, however, such as polyester and olefins, have been developed with enhanced moisture transporting properties. Such fibers, known as channel fibers or modified cross section fibers, are extruded with channels or grooves along which moisture can move through the fiber to the surface by capillary action. Examples of preferred channel fibers include the 4DG Deep Grooved Fiber sold by Fiber Innovation Technology, SORBTEC sold by Unifi, and TECHNOFINE sold by Indemitsu Technofine Company in Japan.

Figure 4:
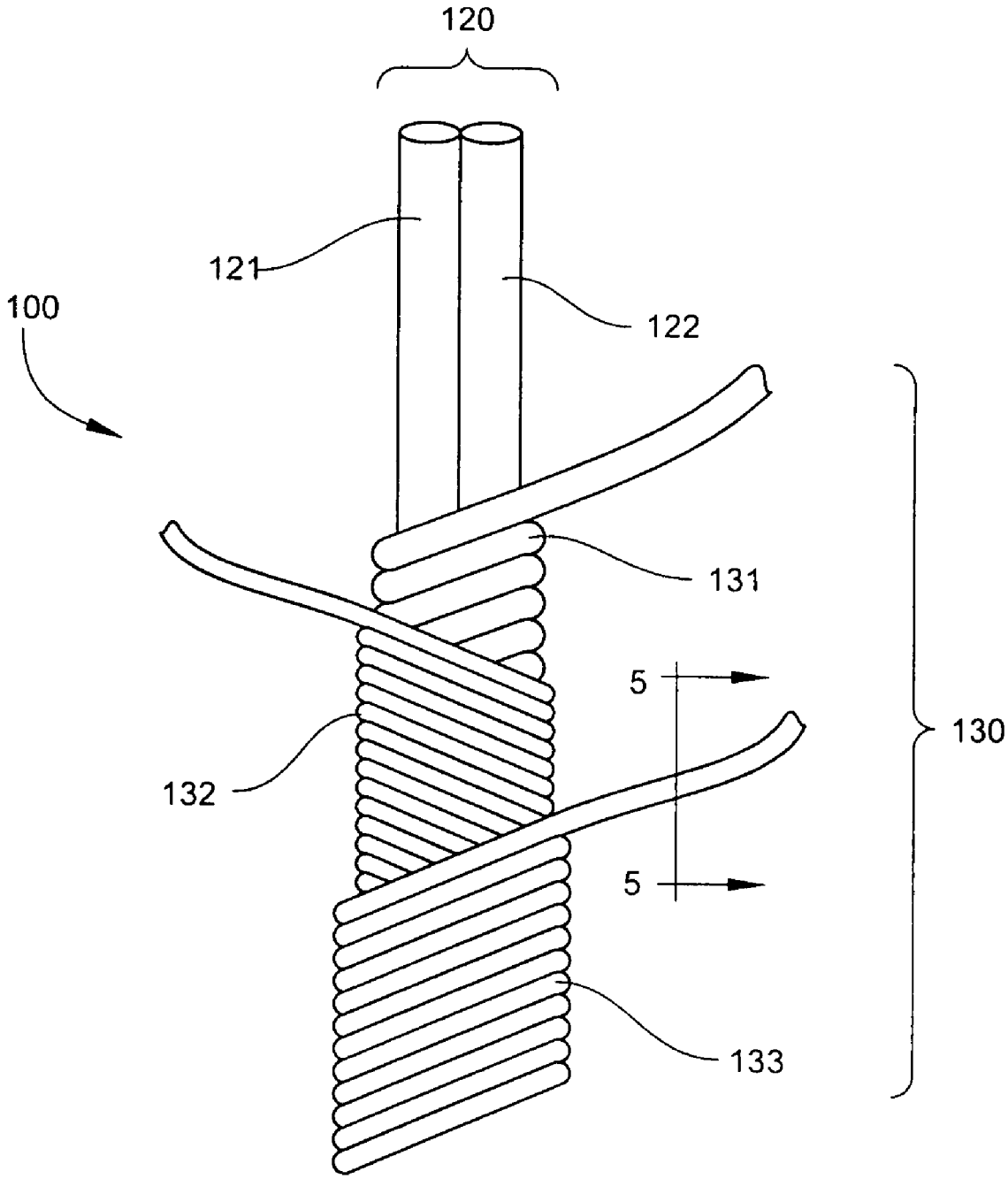
FIG. 4 is a schematic view of another yarn construction according to the invention including a channel yarn.

A protective yarn utilizing channel fibers according to a preferred embodiment of the invention is illustrated in FIG. 4, and shown generally at reference numeral 100. The protective yarn 100 is a composite which includes a core member 120 and a cover member 130. The core member 120 comprises a strand of fiberglass 121 and a strand of polypropylene 122. The polypropylene strand 122 is treated with and incorporates a moisture activated antimicrobial compound. A polyester strand can be substituted for polypropylene.

Figure 5:
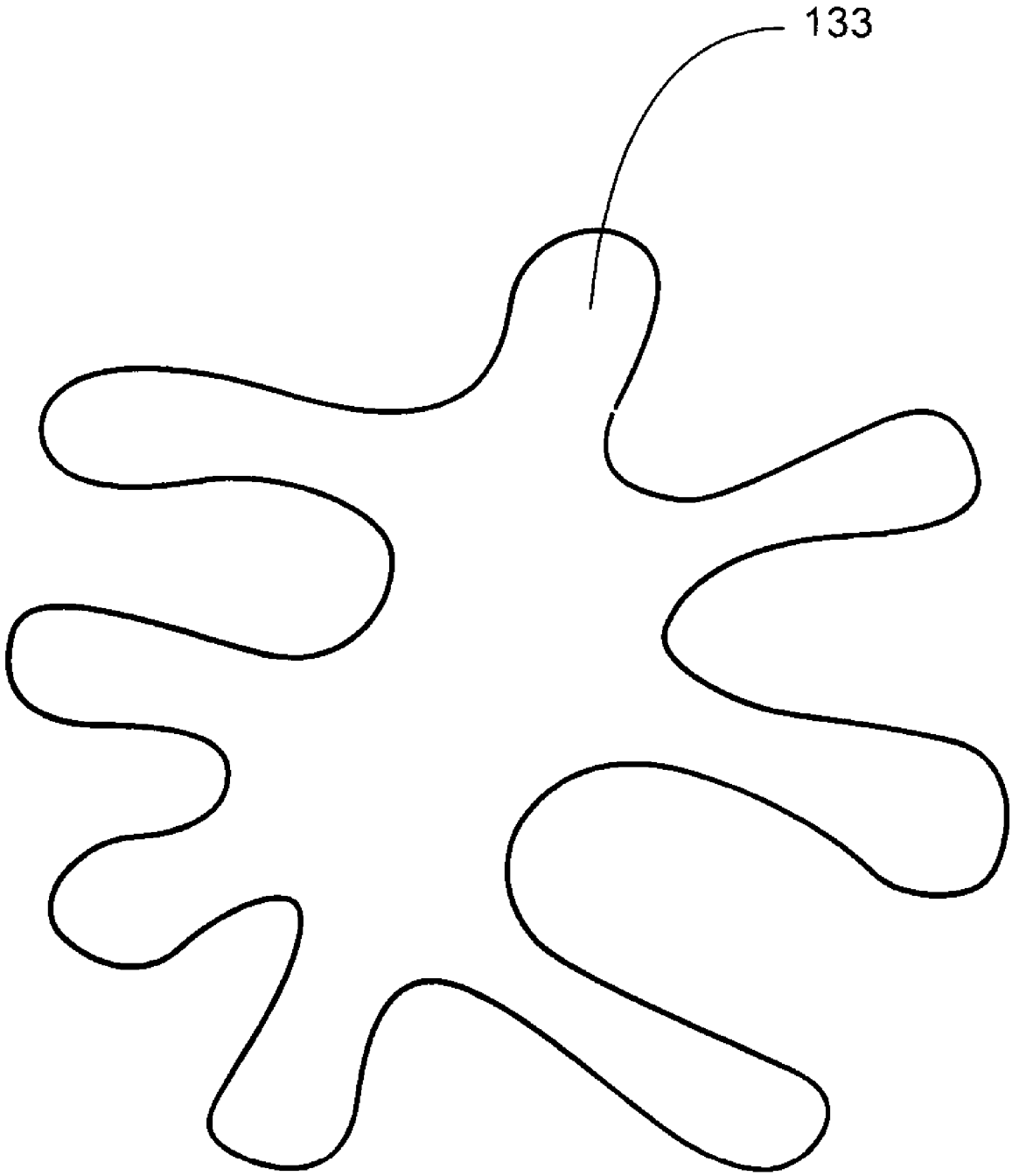
FIG. 5 is a partial cross sectional view of the yarn construction of FIG. 4, shown along lines 5—5.

As shown in FIG. 1, the cover member 30 is preferably comprised of three helically-wrapped cover yarns—an inner cover yarn 131, wrapped, wound or twisted on the core member 120, a middle cover yarn 132 wrapped, wound or twisted on the inner cover yarn 131 such that the orientation of the middle cover helix is opposite that of the inner cover yarn 131, and an outer cover yarn 133 wrapped, wound or twisted on the middle cover 132 such that the orientation of the outer cover helix is opposite that of the middle cover yarn 132. The inner cover yarn 131 is a 375 denier, extended chain polyolefin yarn, such as is sold under the name T1000 SPECTRA. The middle cover yarn 132 is a polyester yarn treated with and incorporating a moisture activated antimicrobial compound. The outer cover yarn 133 is an untreated polyester channel fiber. The modified cross sectional shape of the channel fiber 133 is shown in FIG. 5. It should be noted that while FIG. 5 shows a particular cross sectional shape of the channel fiber, the cross section of the channel fiber can be of any non-circular shape having grooves or holes extending therein, such as a "C", "S" "I" or "W" shape.

The channel fiberfacilitates the migration of moisture into the composite yarn 100, and the movement of moisture within the composite yarn 100. Movement of the moisture along the channel fiber allows the moisture to contact the antimicrobial compound within the composite yarn 100 to activate the antimicrobial compound. In addition, upon contacting the antimicrobial compound, the continued movement of moisture facilitated by the channel fiber causes the migration of the antimicrobial compound to the outer surface of the composite yarn 100 to further enhance efficacy of the antimicrobial compound.

Ambient moisture in the air causes a low level of antimicrobial release. As the level of moisture increases, antimicrobial activity is increased. When the antimicrobial cut-resistant yarn 100 is employed in a garment, a glove, for example, the moisture from the skin of the wearer moves through the moisture-transporting channel fiber which is in direct contact with the fibers containing the antimicrobial. The entire composite yarn bundle 100 is thereby suffused with moisture and increases the antimicrobial effectiveness. Likewise, if the wearer of a glove made with the antimicrobial cut resistant yarn 100 is working in a damp medium, the moisture from the medium is transported by capillary action throughout the glove, rather than repelled by the hydrophobic fibers common in the existing art.

It is generally desirable to minimize the amount of antimicrobial compound used in such garments. As such, a significant advantage of the composite yarn 100 of the present invention is that the increased efficacy brought about by the use of channel fibers decreases the amount of antimicrobial compounded needed for an effective antimicrobial garment.

In an alternative embodiment, the composite yarn has a core member comprised of a fiberglass strand and a polyester channel fiber. The inner cover yarn is an extended chain polyolefin yarn. The middle cover yarn is a polyester strand treated with the antimicrobial compound, and the outer cover is an untreated polyester strand. Alternatively, the outer cover can be a polyester channel fiber treated with the antimicrobial compound.

It should be noted that there are many other possible embodiments of the invention utilizing one or more channel fibers and one or more antimicrobial treated fibers. The channel fiber can be positioned in the core, cover, or both, as can the antimicrobial treated fiber.

An antimicrobial, cut-resistant composite yarn and a garment constructed from such a yarn are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. An antimicrobial, cut-resistant composite yarn, comprising:

(a) a core including at least one cut-resistant strand;

(b) a cover including at least one strand wrapped around and enclosing the core;

(c) wherein the at least one strand in the cover is treated with and incorporates a moisture activated antimicrobial compound; and (d) further wherein at least one strand of either the core or the cover comprises a channel fiber.

2. An antimicrobial, cut resistant composite yarn according to claim 1, wherein said channel fiber facilitates movement of the moisture within the composite yarn and into contact with the antimicrobial compound, whereby efficacy of the antimicrobial compound is enhanced.

3. An antimicrobial yarn according to claim 1, wherein the channel fiber facilitates migration of the antimicrobial compound to an outer surface of the composite yarn, whereby efficacy of the antimicrobial compound is enhanced.

4. An antimicrobial yarn according to claim 1, wherein the channel fiber facilitates contact between the moisture and the antimicrobial compound at an outer surface of the composite yarn, whereby efficacy of the antimicrobial compound is enhanced.

5. An antimicrobial yarn according to claim 1, wherein said cut-resistant strand is selected from the group consisting of fiberglass, metal wire, aramid and polyolefin fiber.

6. An antimicrobial yarn according to claim 1, wherein said core comprises a cut-resistant strand and a synthetic core yarn, and further wherein said synthetic core yarn is treated with and incorporates the antimicrobial compound.

7. An antimicrobial yarn according to claim 6, wherein said synthetic core yarn is selected from the group consisting of polyester, polyethylene, polypropylene, nylon, acetate, and extended chain polyolefin.

8. An antimicrobial yarn according to claim 1, wherein said cover comprises at least one strand selected from the group consisting of polyester, polyethylene, polypropylene, nylon, acetate, and extended chain polyolefin.

9. An antimicrobial yarn according to claim 1, wherein said core comprises said channel fiber.

10. An antimicrobial yarn according to claim 1, wherein said cover comprises said channel fiber.

11. An antimicrobial yarn according to claim 1, wherein said channel fiber is selected from the group consisting of polyester and olefins.

12. An antimicrobial, cut-resistant composite yarn according to claim 1, wherein said core comprises at least one cut-resistant strand and at least one synthetic yarn strand residing in substantially parallel relation to each other.

13. An antimicrobial, cut-resistant composite yarn according to claim 12, wherein said at least one cut-resistant strand comprises fiberglass, and said at least one synthetic yarn strand comprises polypropylene.

* * * * *